US007140933B2

(12) United States Patent
Nakamura et al.

(10) Patent No.: US 7,140,933 B2
(45) Date of Patent: Nov. 28, 2006

(54) COWLING ASSEMBLY FOR OUTBOARD MOTOR

(75) Inventors: Daisuke Nakamura, Hamamatsu (JP); Atsushi Nakamura, Hamamatsu (JP)

(73) Assignee: Yamaha Marine Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 11/047,408

(22) Filed: Jan. 31, 2005

(65) Prior Publication Data

US 2005/0208846 A1 Sep. 22, 2005

(30) Foreign Application Priority Data

Jan. 30, 2004 (JP) ..... 2004-024891

(51) Int. Cl.
*B63H 20/32* (2006.01)

(52) U.S. Cl. ..... 440/77

(58) Field of Classification Search ..... 440/77
See application file for complete search history.

(56) References Cited

U.S. PATENT DOCUMENTS 4,930,790 A * 6/1990 Sheridan ..... 277/630
4,968,276 A * 11/1990 Hashimoto ..... 440/77
4,971,587 A * 11/1990 Uchida et al. ..... 440/77
5,011,102 A * 4/1991 Kiefer ..... 248/37.3
5,018,998 A * 5/1991 Kato ..... 440/77
5,215,485 A * 6/1993 Bonner et al. ..... 440/77
5,338,236 A * 8/1994 Dunham et al. ..... 440/77
6,840,827 B1 * 1/2005 Vignau ..... 440/77

FOREIGN PATENT DOCUMENTS

JP 2002-349257 4/2002

* cited by examiner

*Primary Examiner*—Stephen Avila
(74) *Attorney, Agent, or Firm*—Knobbe, Martens, Olson & Bear, LLP

(57) ABSTRACT

A cowling assembly for an outboard motor includes a top cowling and a bottom cowling for covering an internal combustion engine. The top cowling is formed by pressing a nonferrous material, and has a curved part formed around an opening edge thereof by pressing the opening edge inward into a curled or a hemming shape. A hook mounting member for supporting a hook that attached the top cowling to the bottom cowling is secured to the inside of the top cowling and is engaged with the curved part formed around the opening edge.

21 Claims, 12 Drawing Sheets

COWLING ASSEMBLY FOR OUTBOARD MOTOR

PRIORITY INFORMATION

The present application is based on and claims priority under 35 U.S.C. 119 to Japanese Patent Application No. 2004-024891, filed on Jan. 30, 2004, the entire contents of which are expressly incorporated by reference herein.

BACKGROUND OF THE INVENTIONS

1. Field of the Inventions

The present inventions relate generally to a cowling assembly for covering an internal combustion engine of an outboard motor, and more particularly to an improved cowling assembly having top and bottom cowlings that attach to one another by engaging hooks attached to the top and bottom cowlings.

2. Description of the Related Art

Conventionally, outboard motors include internal combustion engines covered with top and bottom cowlings. The top and bottom cowlings often attach to one another by engaging bottom-side hooks attached to the opening edge of the bottom cowling and top-side hooks attached to the opening edge of the top cowling. For example, Japanese patent JP2002349257A2, entitled OUTBOARD MOTOR, discloses such an arrangement.

SUMMARY OF THE INVENTION

An aspect of at least one invention described herein includes the realization that when hook mounting bosses for securing the top-side hooks are formed integrally with the top cowling by molding, the top cowling can be excessively thick in some areas. The top cowling is thus heavier, especially when the top cowling is made of a reinforced resin, as is frequently the case. To address such a need, an aspect of at least one of the inventions described herein involves providing a cowling assembly with a top cowling of lighter weight that is strong enough to support hook mounting bosses for securing the top-side hooks.

Another aspect of at least one of the inventions described herein includes the realization that although mounting bosses for securing top-side hooks can be formed separately from the top cowling and can then be attached to the top cowling, the joints of such separately formed bosses are usually at least partially exposed to the outside of the top cowling, which adversely affects the appearance of the outboard motor. To address such a need, an aspect of at least one of the inventions described herein involves providing a cowling assembly wherein mounting bosses for securing top-side hooks are not visible from the outside of the top cowling.

BRIEF DESCRIPTION OF THE DRAWINGS

These and other features, aspects, and advantages of the present invention are described below with reference to the drawings of preferred embodiments, which embodiments are intended to illustrate and not to limit the present invention.

DETAILED DESCRIPTION OF THE PREFERRED EMBODIMENTS

FIGS. 1–11 illustrate a cowling assembly 7 for an outboard motor 1 configured in accordance with certain features, aspects, and advantages of at least one invention described herein. The outboard motor 1 merely exemplifies one type of outboard drive in which the present cowling assemblies have particular utility. However, the various cowling assemblies disclosed herein can be used with other types of devices that benefit from cowling types of enclosures. Such applications will be apparent to those of ordinary skill in the art in view of the description herein. These inventions are not limited to the embodiments described, which include the preferred embodiments, and the terminology used herein is not intended to limit the scope of the present invention.

Figure 1:
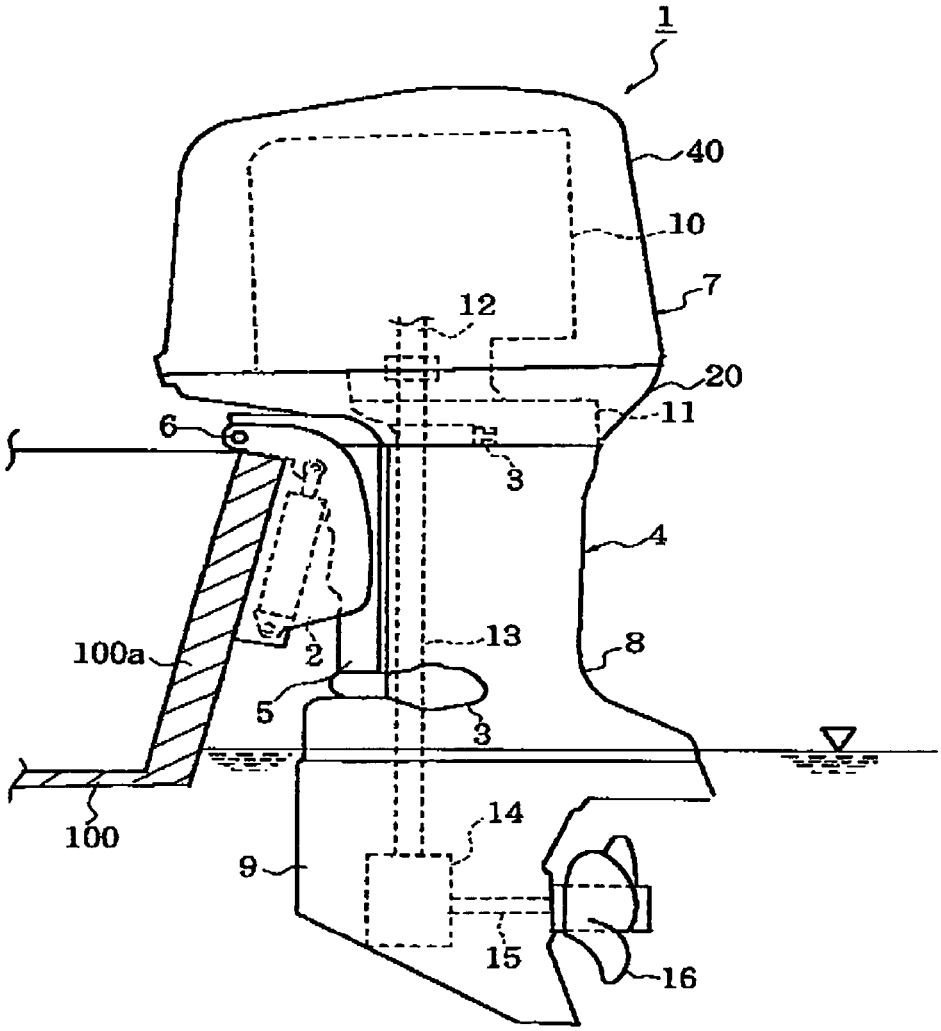
FIG. 1 is a side view of one embodiment of an outboard motor, having top and bottom cowling members and with certain internal components illustrated in phantom line.

The general structure of an outboard motor is described with reference to FIG. 1. As depicted in FIG. 1, an outboard motor 1 is attached to a stem plate 100*a* of a hull 100 of a boat or other watercraft by a clamp bracket 2. A swivel bracket 5, having upper and lower damper members 3 for elastically supporting a propulsion unit 4, is supported for vertical rotation by a cramp bracket 2 via a tilt shaft 6.

The propulsion unit 4 has a housing comprising a cowling assembly 7, an upper case 8, and a lower case 9. An internal combustion engine 10, such as, for example, a four-cycle internal combustion engine, can be housed in the cowling assembly 7. However, other engines can also be used. In various embodiments, the upper case 8 is attached to a lower part of an exhaust guide plate 11. The internal combustion engine 10 can be supported on the exhaust guide 11 plate.

As depicted in FIG. 1, the internal combustion engine 10 has a crankshaft 12 extending vertically and connected to an upper end of a drive shaft 13, which extends vertically through the upper case 8. A lower end of the drive shaft 13 is connected to a forward/reverse switching mechanism 14 housed in the lower case 9. A propeller shaft 15 extends horizontally from the forward/reverse switching mechanism 14 and has a rear end, which protrudes outside of the lower case 9, and to which a propeller 16 is attached.

The cowling assembly 7 can comprise a bottom cowling member 20 and a top cowling member 40 that, in various embodiments, attach to one another, described in greater detail below with reference to FIGS. 2 to FIG. 10.

Figure 2:
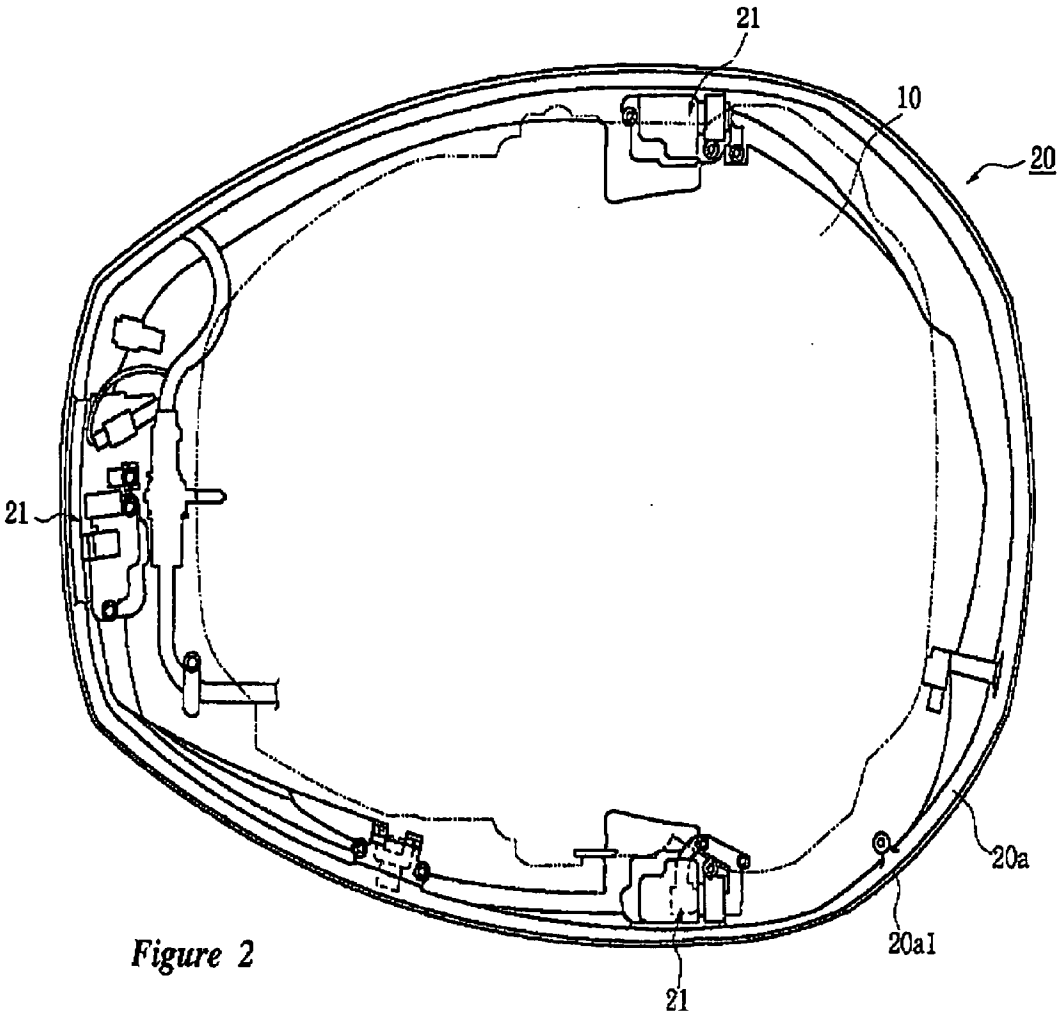
FIG. 2 is a top plan view of the outboard motor of FIG. 1 with a top cowling member removed and an engine illustrated in phantom line.

FIG. 2 is a plan view of one embodiment of the bottom cowling 20, with the internal combustion engine 10 illustrated in phantom line. The bottom cowling 20 can be made of an aluminum material by die-casting, or any other method.

Figure 7:
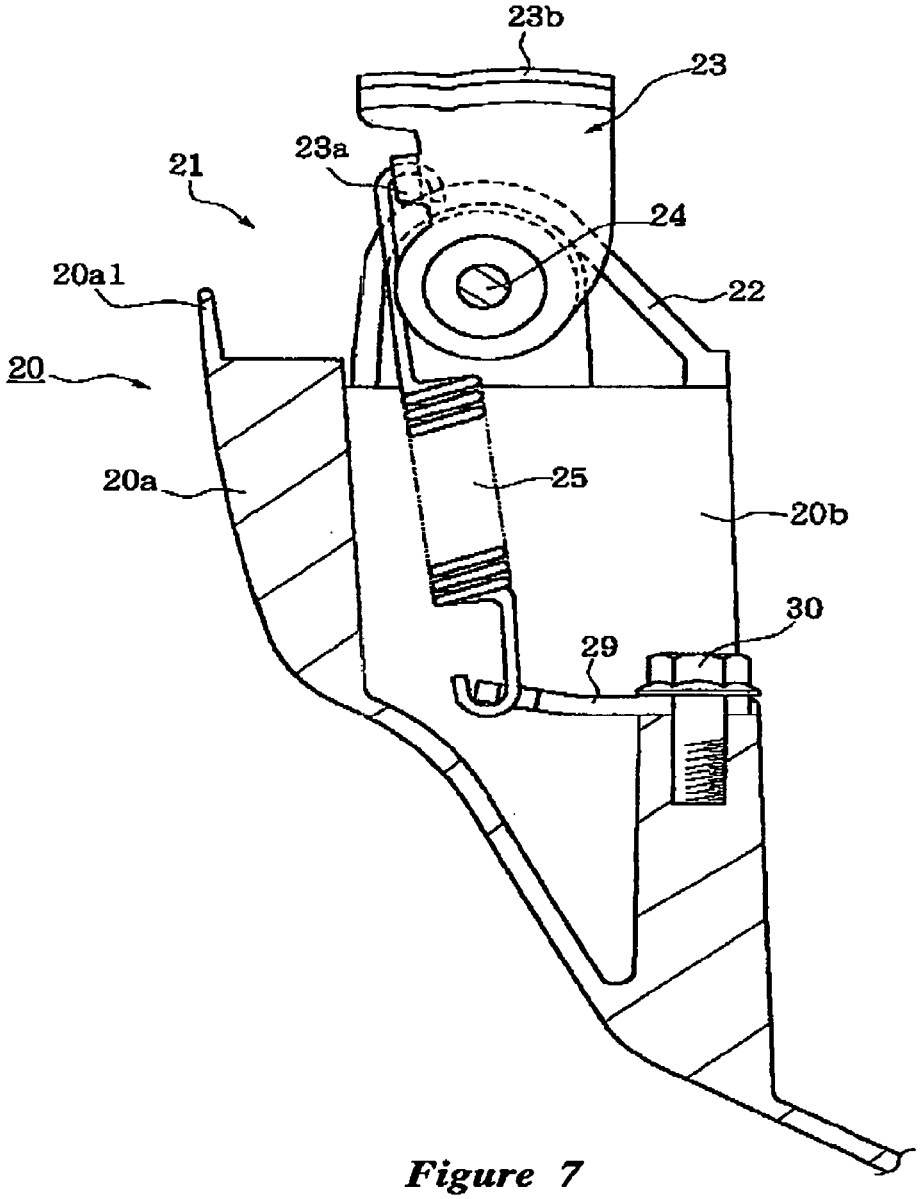
FIG. 7 is a cross-sectional view of FIG. 5 taken along the VII—VII line.

The bottom cowling 20 has an opening edge 20*a*, from which a rib 20*a*1 extends upwards, also shown in another perspective in FIG. 7. The rib 20*a*1 can be configured to form a seal between the bottom cowling 20 and the top cowling 40, also described below with reference to FIG. 10.

Bottom-side attachment assemblies 21 can be provided at a plurality of positions along the opening edge 20*a* of the bottom cowling 20. For example, in the embodiment depicted in FIG. 2, bottom-side attachment assemblies 21 are provided at three positions along the opening edge 20*a* of the bottom cowling 20, namely, at a position that faces the hull 100 and at positions on the port and starboard sides of the bottom cowling 20. The bottom-side attachment assemblies 21 are described in greater detail below with reference to FIGS. 5–7.

Figure 3:
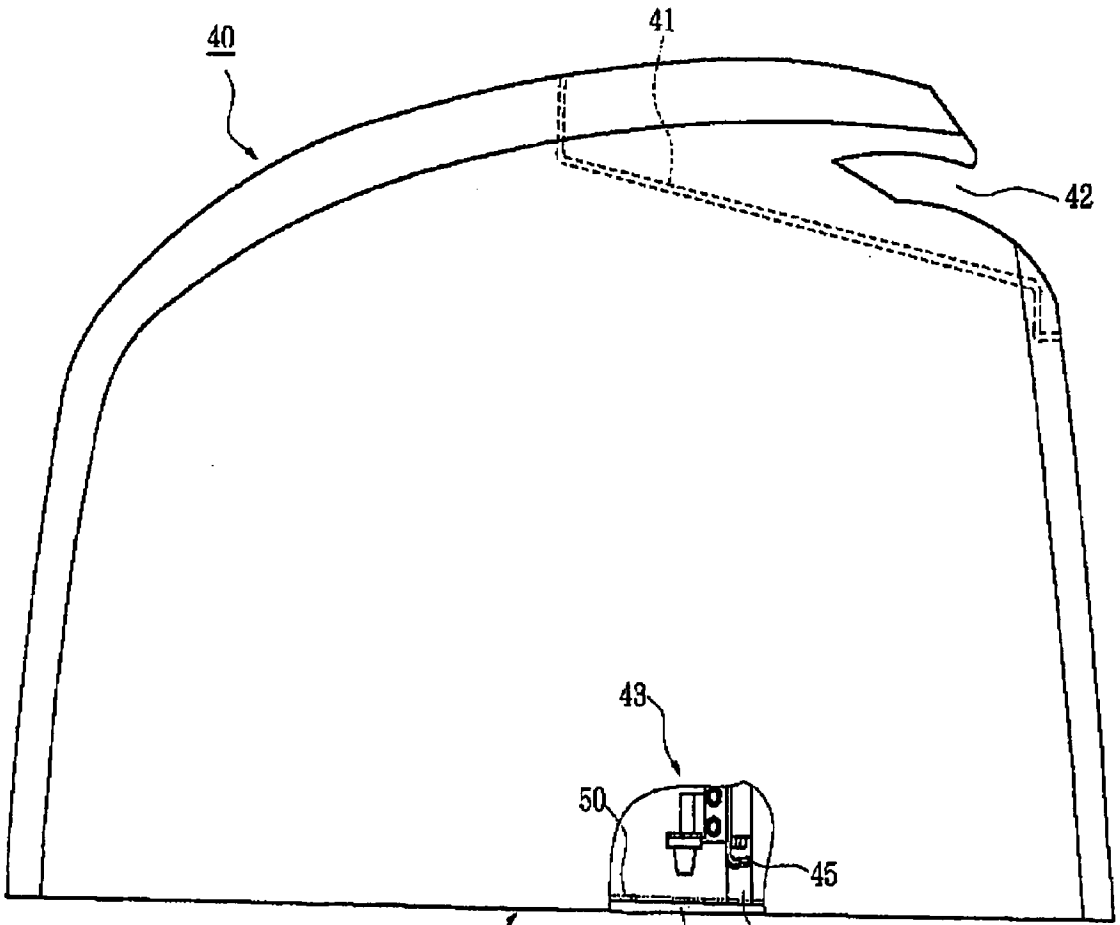
FIG. 3 is a side elevational and partial cut-away view of the top cowling member of FIG. 1 removed from the outboard motor, and illustrating a top-side attaching part of the top cowling member.
Figure 4:
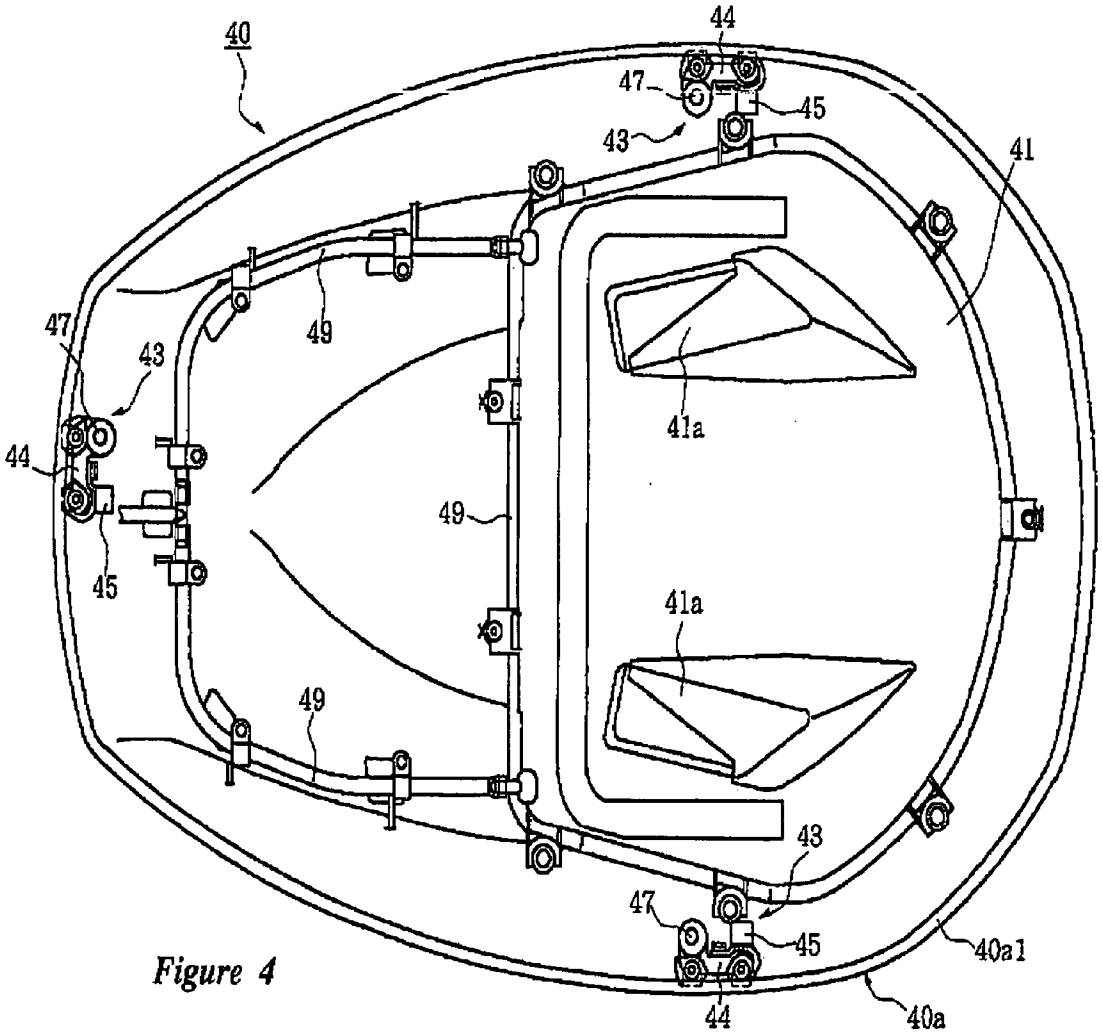
FIG. 4 is a bottom plan view of the top cowling member removed from the outboard motor.

FIGS. 3 and 4 provide two views of an embodiment of a top cowling 40. FIG. 3 is a side view of the top cowling member 40, from which an exterior part is cut away to reveal a top-side attachment assembly 43 inside the top cowling member 40. The top-side attachment assembly 43 is described in greater detail below.

FIG. 4 is bottom plan view of one embodiment of the top cowling 40. The top cowling 40 can be provided with a baffle plate 41 covering an intake opening 42 of the top cowling 40. The baffle plate 41 can include a pair of right and left air intake openings 41*a*. Air introduced through the intake opening 42 and sucked through the air intake openings 41*a* can be used to cool the engine 10. The air can also be sucked through an air cleaner (not shown) and then into the engine 10 for combustion therein. Water drops separated by the baffle plate 41 are collected into a discharge hose 49 and can be discharged so as not to fall onto the engine 10.

In various embodiments, the top cowling 40 can made by pressing a nonferrous material into a desired shape. For example, the top cowling 40 can be formed by pressing a plate of a aluminum or magnesium. However, other materials can also be used.

When the top cowling 40 is formed by pressing a nonferrous material, it can be thinner as compared with cowlings produced by using other metals. Also, when the top cowling 40 is pressed from aluminum, the top cowling 40 is recyclable and can largely contribute to the weight reduction of the outboard motor 1. Additionally, when the top cowling 40 is formed by pressing a nonferrous metal, the top cowling 40 can be formed without burring and buff finishing can be used to provide an aesthetically pleasing finish. The appearance of the cowling assembly 7 can thus be improved and the number of steps in the production process to produce the top cowling 40 can be reduced.

Figure 8:
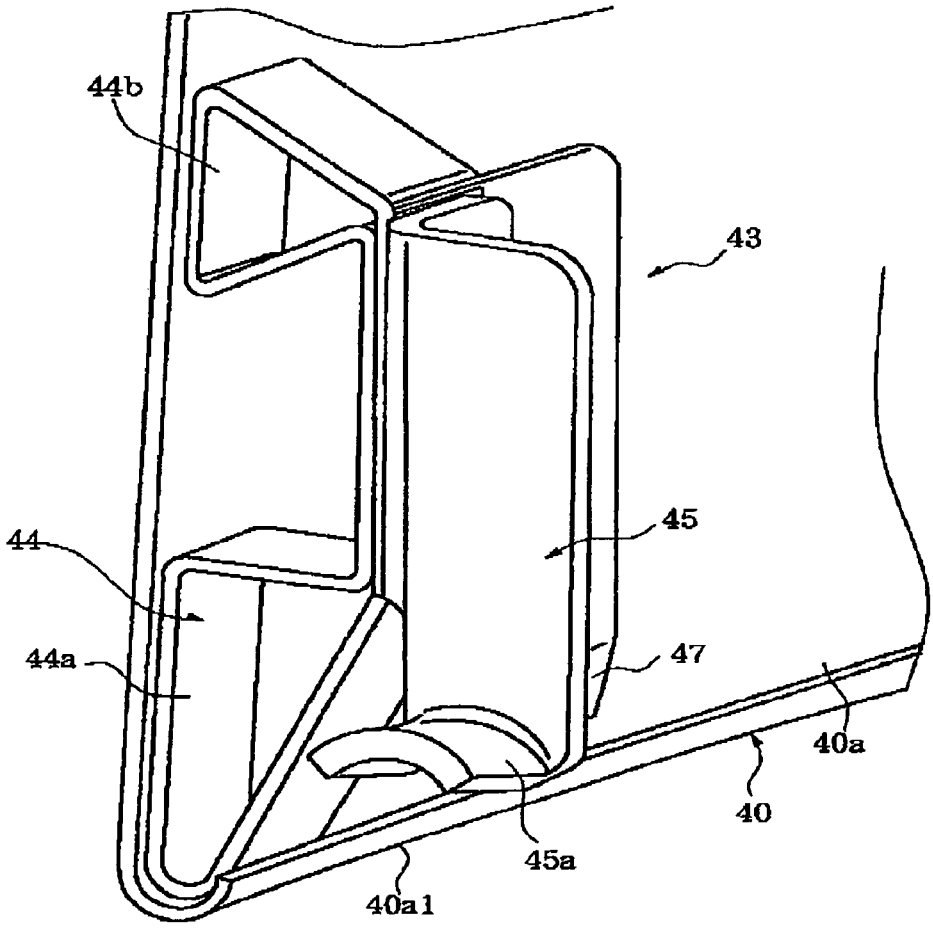
FIG. 8 is an enlarged perspective view of a top-side hook attached to the top cowling.

With continued reference to FIG. 4 the top cowling 40 has an opening edge 40*a*, which can be curved inwardly to form a curved part 40*a*1. In some embodiments, the curved part 40*a*1 is formed by pressing the opening edge 40*a* of the top cowling 40 into a curled shape, as is also shown in FIG. 8. In FIG. 8, the curved part 40*a*1 of the top cowling 40 is curved in an arc. More specifically, in a preferred embodiment, the curved part 40*a*1 is curved into a U-shape with the open portion of the U-shape facing upwardly. The curved part 40*a*1 can be formed continuously all along an inside portion of the opening edge 40*a*.

Since the opening edge 40*a* of the top cowling 40 is formed into a curled shape by pressing to form a curved part 40*a*1 as described above, the rigidity of the top cowling 40 can be significantly improved with a minimum increase in weight. For example, the curved part 40*a*1 increases the stiffness of the opening edge 40*a* and thus provides more resistance to bending along the opening edge 40*a*. Thus, the top cowling 40 can be light in weight while providing rigidity and mounting strength in the area around the opening.

Figure 10:
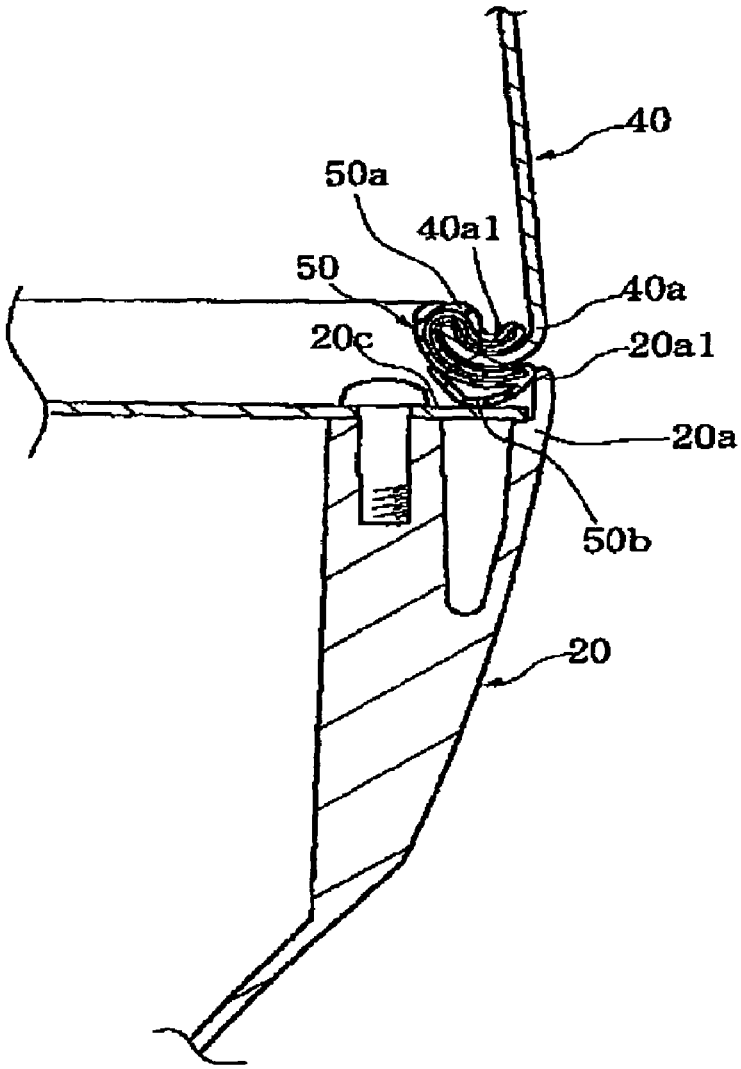
FIG. 10 is a cross-sectional view a seal that can be used between the top cowling and the bottom cowling.

With reference to FIGS. 3 and 4, top-side attachment parts 43 are provided at a plurality of positions in the top cowling 40, corresponding generally to the bottom-side attachment parts 21 provided in the bottom cowling 20. In the embodiments depicted in FIGS. 3 and 4, three top-side attachment parts 43 are provided, one near a portion of the top cowling 40 near the hull when the top cowling 40 is positioned as depicted in FIG. 1, and two in positions on opposing sides of the top cowling 40, along the opening edge 40*a* of the top cowling 40. As shown in the cut-away portion of FIG. 3, a seal member 50, which will be described in greater detail with reference to FIG. 10, is provided along the curved part 40*a*1 of the opening edge 40*a*.

In a preferred embodiment, each of the top-side attaching parts 43 comprises a hook mounting member 44, a top-side hook 45, and a positioning damper 47. FIG. 8 is a view illustrating a top-side hook attached to the top cowling. As shown in FIG. 8, the hook mounting member 44 has a lower attaching arm 44*a* and an upper attaching arm 44*b*. The lower attaching arm 44*a* of the hook mounting member 44 has a lower portion, which conforms with and is nested in the inside of the curved part 40*a*1 of the opening edge 40*a* of the top cowling 40.

In a preferred embodiment, the lower attaching arm 44*a* and the upper attaching arm 44*b* are bonded to an inside of the top cowling 40 with an adhesive. In other embodiments, securing the hook mounting members 44 to the inside of the top cowling 40 is not limited to an adhesive. For example, in some embodiments, the hook mounting members 44 can be secured to the curved part 40*a*1 formed along the opening edge 40*a* of the top cowling 40 with adhesive, welding, swaging, rivets, threaded fasteners, and the like. The hook mounting members 44 can thus be securely attached to the top cowling 40 in such a manner that the hook mounting members 44 and other attaching parts are not exposed and are not visible from the outside of the cowling assembly 7. Thus, the appearance of the cowling assembly can be significantly improved.

Figure 5:
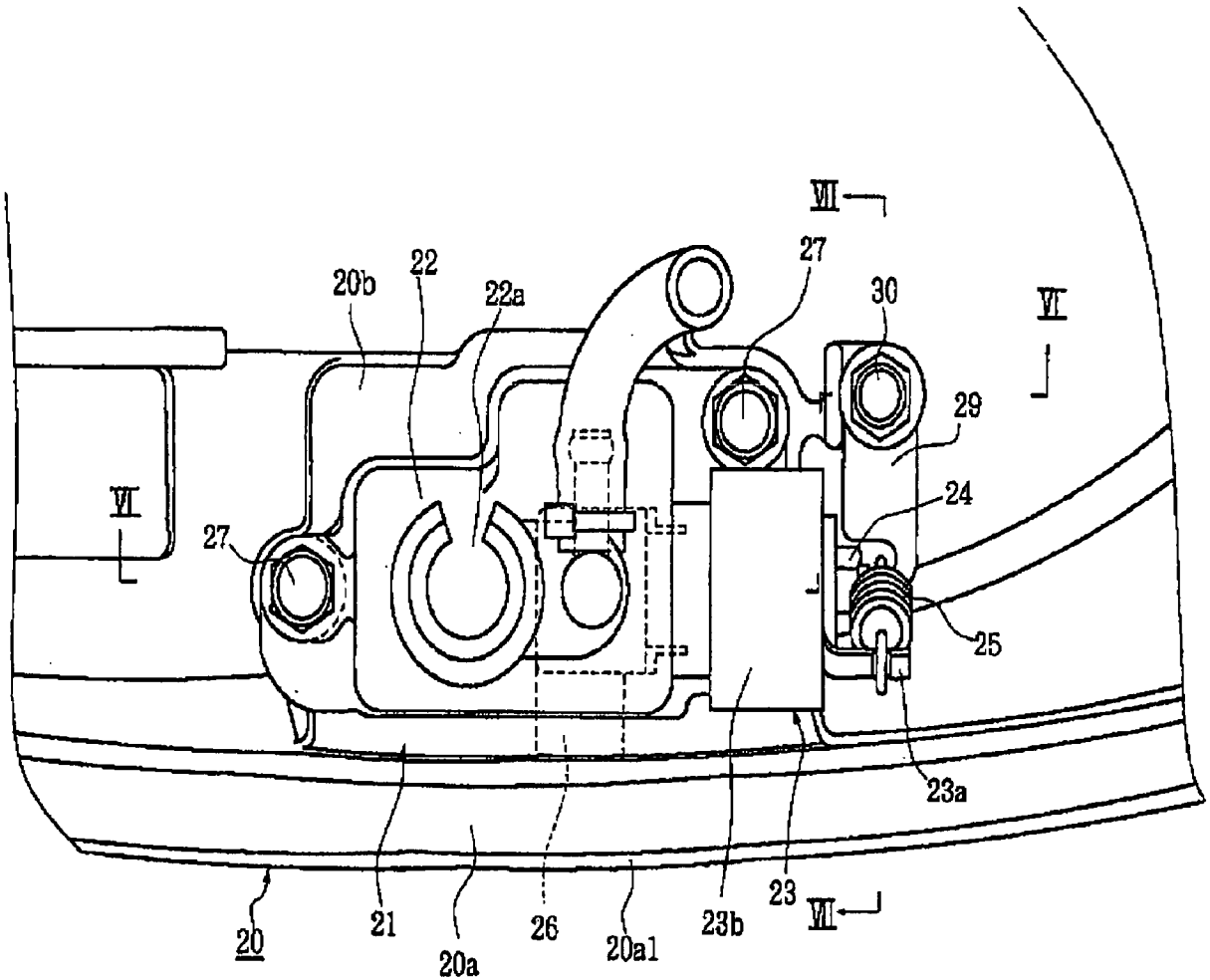
FIG. 5 is an enlarged top plan view of a bottom-side attaching part connected to the bottom cowling member.
Figure 6:
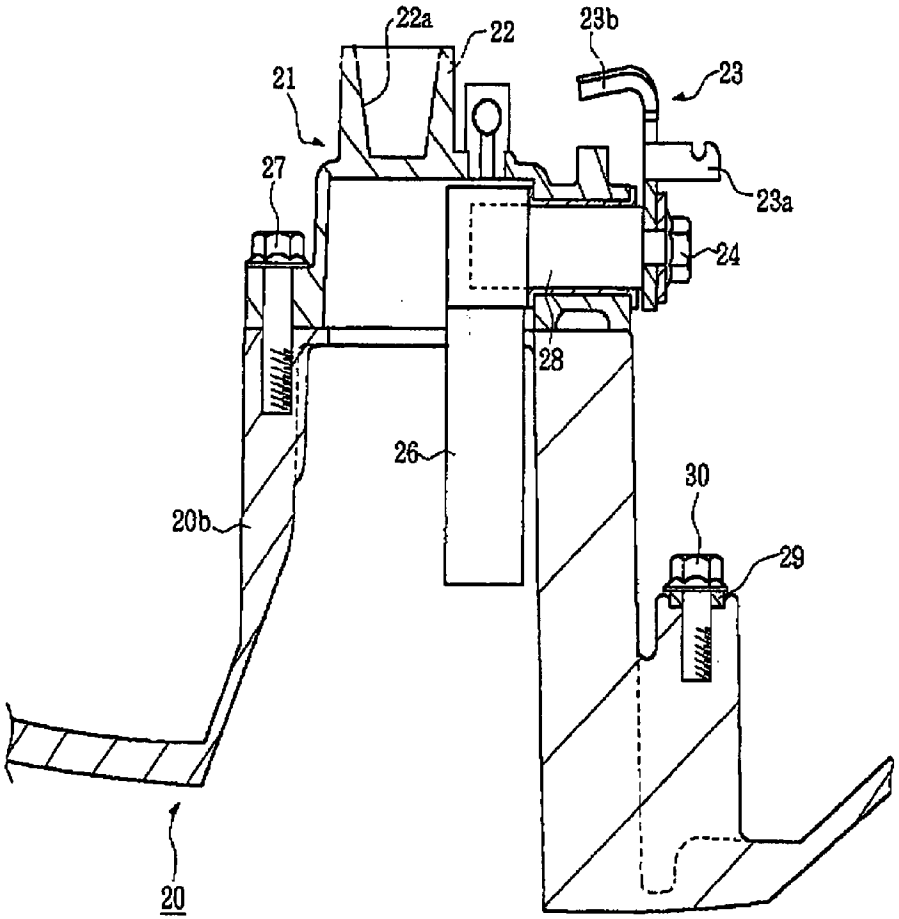
FIG. 6 is a cross-sectional view of FIG. 5 taken along the VI—VI line.

FIG. 5 is a plan view of a bottom-side attaching assembly 21. Each of the bottom-side attachment assemblies 21 comprises a supporting holder 22, a bottom-side hook 23, a hook mounting bolt 24, a spring 25, and a lever 26. The supporting holder 22 is secured to a mounting boss 20*b* extending inward from the opening edge 20*a* of the bottom cowling 20 by mounting bolts 27.

The bottom-side hook 23 is attached, by the hook mounting bolt 24, to a supporting shaft 28 rotatably supported by the supporting holder 22. A stay 29 is attached to the mounting boss 20*b* by a mounting bolt 30, and the spring 25 is provided between the stay 29 and a supporting part 23*a* of the bottom-side hook 23. The spring 25 is configured to bias the bottom-side hook 23 toward the illustrated position, which is a locking position. The supporting holder 22 has a positioning recess 22*a*.

Figure 9:
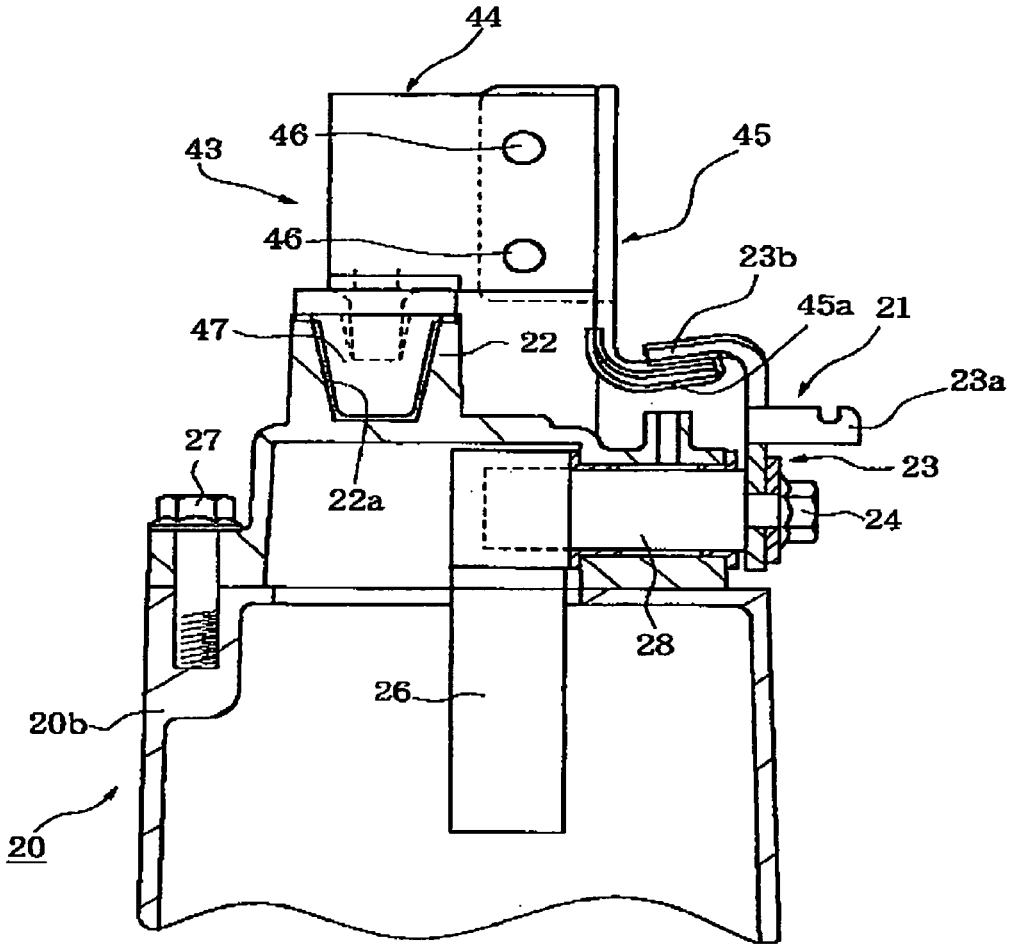
FIG. 9 is a front elevational and partial sectional view of the top and bottom-side hook assemblies in an attached state.

FIG. 9 shows the attached state of the top cowling 40 and the bottom cowling 20. To close the top cowling 40, engaging parts 45*a* of the top-side hooks 45 are aligned with the bottom side hooks 23, with the bottom side hooks 23 in an unlocked position (not shown). The bottom side hooks 23 are then rotated to the locked position such that the bottom side hooks 23 are engaged with the top side hooks 45, as shown in FIG. 9.

When the top cowling 40 and the bottom cowling 20 are attached to each other, the positioning dampers 47 of the top-side attaching parts 43 are engaged with the positioning recesses 22*a* of the bottom-side attaching parts 21, thereby providing a predetermined alignment between the top and bottom cowling members 40, 20.

FIG. 10 is a cross-sectional view a seal that can be formed between the top cowling 40 and the bottom cowling 20. When the top cowling 40 and the bottom cowling 20 are attached to one another, the seal member 50 can provide a seal between the top cowling 40 and the bottom cowling 20.

The seal member 50 can include an engaging part 50*a* and a seal part 50*b*. In the embodiment shown in FIG. 10, the seal member 50 is attached to the top cowling 40 by engaging the engaging part 50*a* with the curved part 40*a*1 formed along the opening edge 40*a* of the top cowling 40 except for the portions of the opening edge 40*a* where there are the lower attaching arms 44*a* of the hook mounting members 44. The seal part 50*b* of the seal member 50 can extend all along the opening edge 40*a*.

When the top cowling 40 and the bottom cowling 20 are attached to each other, the seal part 50*b* is pressed against the rib 20*a*1 formed along the opening edge 20*a* of the bottom cowling 20 and along a flat part 20*c* inside the opening edge 20*a* to provide a seal. In this embodiment, the seal is formed by the curved part 40*a*1 along the opening edge 40*a* of the top cowling 40 and the opening edge 20*a* of the bottom cowling 20, and since the seal member 50 is compressed when the top cowling 40 is attached to the bottom cowling 20, a good seal is formed with ease and reliability. Although the seal member 50 is shown as being attached to the top cowling 40 in this embodiment, in other embodiments, the seal member 50 can be attached to the bottom cowling 20.

Figure 11:
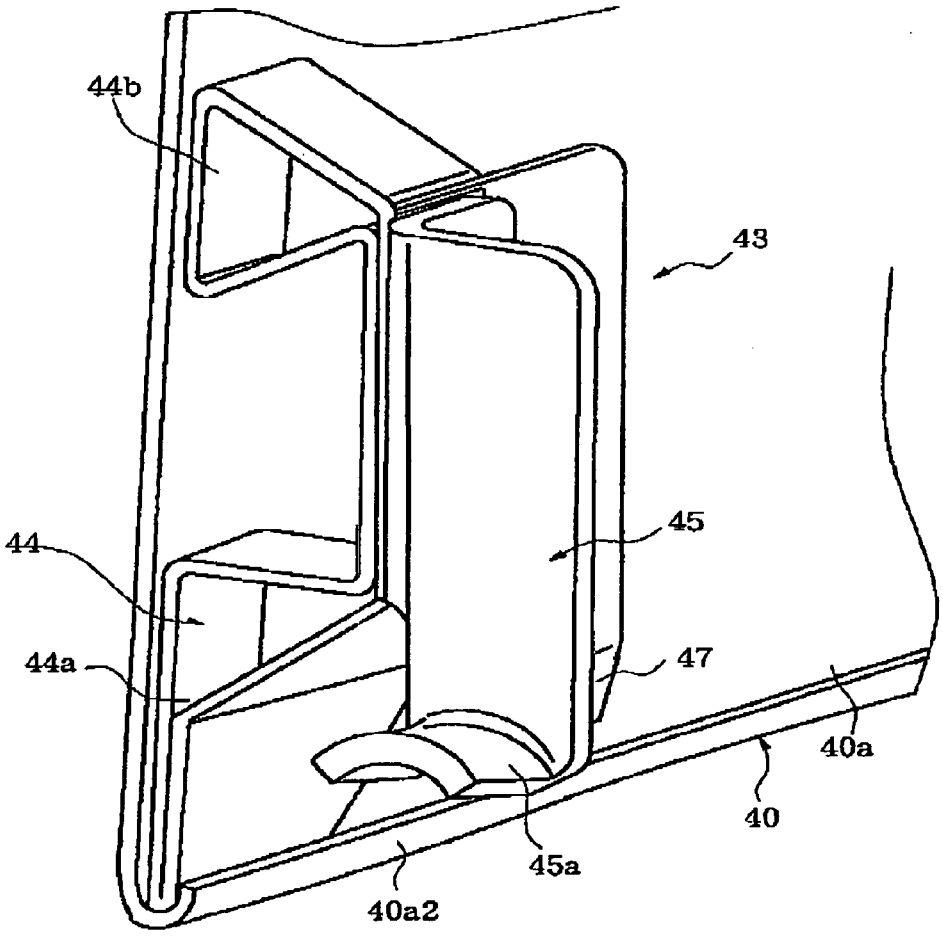
FIG. 11 is an enlarged perspective view of a modification of the top-side hook attached to the top cowling of FIG. 8.
Figure 12:
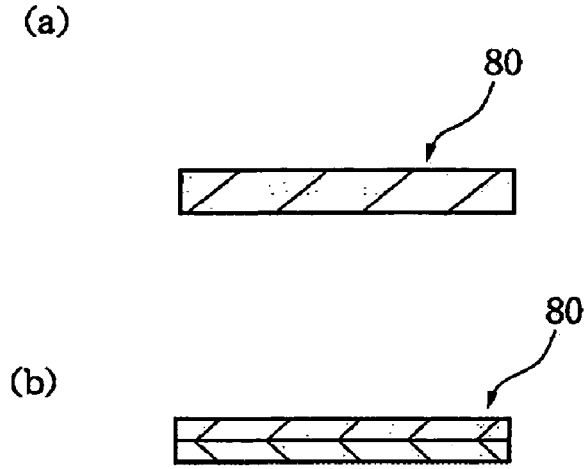

FIG. 11 is a view illustrating a second embodiment of the top-side hook attached to the top cowling. In this embodiment, the opening edge 40*a* of the top cowling 40 is pressed into a more severely folded shape that that illustrated in FIG. 8 to form a curved part 40*a*2. This configuration can be referred to as a "hemmed" shape. Here the curved part 40*a*2 is folded relatively flat, although the hemmed shape still allows for engagement with lower portion of the hook mounting member 44.

As depicted in FIG. 11, a lower portion of the hook mounting member 44 secured to the inside of the top cowling 40 is shaped to fit the relatively flattened curved part 40*a*2 of this embodiment and to be engaged with and fixed to the curved part 40*a*2 formed along the opening edge 40*a* of the top cowling 40. As described above with respect to the embodiment depicted in FIG. 8, the hook mounting members 44 can thus be securely attached to the top cowling 40 in such a manner that the hook mounting members 44 and other attaching parts are not exposed and are not visible from the outside of the cowling assembly 7. Thus, the appearance of the cowling assembly 7 can be significantly improved.

Since the opening edge 40*a* of the top cowling 40 is formed into a hemmed shape by pressing to form a curved part 40*a*2 as described above, the rigidity of the top cowling 40 can be significantly improved with a minimum increase in weight. Thus, as described with respect to the curl-shaped curved part 40*a*1 depicted in FIG. 8, the top cowling 40 can be light in weight while providing rigidity and mounting strength in the area around the opening edge 40*a*.

Although this invention has been disclosed in the context of certain preferred embodiments, it will be understood by those skilled in the art that the present invention extends beyond the specifically disclosed embodiments to other alternative embodiments and/or uses of the invention and obvious modifications and equivalents thereof. It is also contemplated that various combinations or sub-combinations of the specific features and aspects of the embodiments can be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A cowling assembly for covering an internal combustion engine of an outboard motor, the cowling assembly comprising:

a bottom cowling; and a top cowling formed of a nonferrous metal material, wherein the top cowling comprises an outer wall that extends downward from a top portion of the top cowling, the outer wall then extending inwards towards an interior cavity of the top cowling, and then extending upwards towards the top portion of the top cowling to form an opening edge with a curved part.

2. The cowling assembly of claim 1, further comprising:

a hook mounting member secured to the inside of the top cowling, wherein a portion of the hook mounting member is engaged with and fixed to the curved part of the opening edge of the top cowling:

a top-side hook attached to the opening edge of the top cowling; and a bottom-side hook attached to an opening edge of the bottom cowling, wherein the bottom-side hook and the top-side hook are arranged to engage with one another.

3. The cowling assembly of claim 1, wherein the bottom cowling further comprises an opening edge of the bottom cowling, and wherein the opening edge of the bottom cowling and the opening edge of the top cowling are arranged to form a seal.

4. The cowling assembly of claim 2, wherein the bottom cowling further comprises an opening edge of the bottom cowling, and wherein the opening edge of the bottom cowling and the opening edge of the top cowling are arranged to form a seal.

5. The cowling assembly of claim 1, wherein the curved part of the opening edge is formed into a curled shape.

6. The cowling assembly of claim 5, wherein the bottom cowling further comprises an opening edge of the bottom cowling, and wherein the opening edge of the bottom cowling and the opening edge of the top cowling are arranged to form a seal.

7. The cowling assembly of claim 5, further comprising:

a hook mounting member secured to the inside of the top cowling, wherein a portion of the hook mounting member is engaged with and fixed to the curved part of the opening edge of the top cowling;

a top-side hook attached to the opening edge of the top cowling; and a bottom-side hook attached to an opening edge of the bottom cowling, wherein the bottom-side hook and the top-side hook are arranged to engage with one another.

8. The cowling assembly of claim 7, wherein the bottom cowling further comprises an opening edge of the bottom cowling, and wherein the opening edge of the bottom cowling and the opening edge of the top cowling are arranged to form a seal.

9. The cowling assembly of claim 1, wherein the curved part of the opening edge is formed into a hemmed-shape.

10. The cowling assembly of claim 9, wherein the bottom cowling further comprises an opening edge of the bottom cowling, and wherein the opening edge of the bottom cowling and the opening edge of the top cowling are arranged to form a seal.

11. The cowling assembly of claim 9, further comprising:

a hook mounting member secured to the inside of the top cowling, wherein a portion of the hook mounting member is engaged with and fixed to the curved part of the opening edge of the top cowling;

a top-side hook attached to the opening edge of the top cowling; and a bottom-side hook attached to an opening edge of the bottom cowling, wherein the bottom-side hook and the top-side hook are arranged to engage with one another.

12. The cowling assembly of claim 11, wherein the bottom cowling further comprises an opening edge of the bottom cowling, and wherein the opening edge of the bottom cowling and the opening edge of the top cowling are arranged to form a seal.

13. The cowling assembly of claim 1, wherein said curved part of said opening edge of said top cowling is formed by a method of pressing.

14. The cowling assembly of claim 1, wherein the curved part of the opening edge is formed into a U-shape, with an open portion of the U-shape facing upwardly.

15. The cowling assembly of claim 5, wherein said curved part of said opening edge of said top cowling is formed by a method of pressing.

16. The cowling assembly of claim 9, wherein said curved part of said opening edge of said top cowling is formed by a method of pressing.

17. The cowling assembly of claim 14, wherein said curved part of said opening edge of said top cowling is formed by a method of pressing.

18. The cowling assembly of claim 1, wherein the top cowling comprises an opening edge that is curved inward and upward to form a curved part, the curved part defining a recess that opens upwardly.

19. The cowling assembly of claim 18, wherein the recess opens upwardly towards a top portion of the top cowling.

20. The cowling assembly of claim 18, wherein the recess opens upwardly when the bottom-side hook and the top-side hook are engaged with one another.

21. The cowling assembly of claim 1, wherein the curved part is formed continuously along an inside portion of the opening edge.

* * * * *